United States Patent [19]

Roller et al.

[11] 4,371,777

[45] Feb. 1, 1983

[54] CONTINUOUS FLOW ELECTRIC WATER HEATER

[75] Inventors: Hanno Roller, Kandel; Karl-Heinz Nauerth, Erlenbach, both of Fed. Rep. of Germany

[73] Assignee: Fritz Eichenauer GmbH and Co. KG, Kandel, Fed. Rep. of Germany

[21] Appl. No.: 212,451

[22] Filed: Dec. 3, 1980

[30] Foreign Application Priority Data

Dec. 3, 1979 [DE] Fed. Rep. of Germany ..... 2948591

[51] Int. Cl.[3] ..... F24H 1/12; H05B 3/02

[52] U.S. Cl. ..... 219/298; 219/283; 219/299; 219/301; 219/302; 219/505; 219/536; 219/541

[58] Field of Search ..... 219/296–299, 219/301–305, 308, 309, 283, 504, 505, 530, 540, 536, 541

[56] References Cited

U.S. PATENT DOCUMENTS

| | | | |
|---|---|---|---|
| 1,215,748 | 2/1917 | Underwood | 219/299 |
| 1,418,011 | 5/1922 | Mehn | 219/301 X |
| 1,420,840 | 6/1922 | Hewitt | 219/299 X |
| 1,523,156 | 1/1925 | Adams | 219/298 X |
| 4,177,375 | 12/1979 | Meixner | 219/301 X |
| 4,327,282 | 4/1982 | Nauerth | 219/541 |
| 4,334,141 | 6/1982 | Roller et al. | 219/298 X |

FOREIGN PATENT DOCUMENTS

| | | | |
|---|---|---|---|
| 2804749 | 8/1979 | Fed. Rep. of Germany | 219/301 |
| 2804818 | 8/1979 | Fed. Rep. of Germany | 219/283 |
| 87348 | 11/1920 | Switzerland | 219/299 |
| 248416 | 2/1948 | Switzerland | 219/299 |
| 474194 | 10/1937 | United Kingdom | 219/299 |

*Primary Examiner*—Anthony Bartis

*Attorney, Agent, or Firm*—Antonelli, Terry & Wands

[57] ABSTRACT

A continuous flow or flash electric water heater, for example for use in a coffee making machine, includes a compound heating structure made up of at least two elongated generally parallelepyred shaped massive heating bodies of a material having a high thermal conductivity, such as brass. Each body has at least one heat input face and a longitudinal passage for flow of water to be continuously heated. The bodies are positioned side-by-side with the passages parallel to each other and with a heat input face of each body facing a heat input face of the next adjacent body. At least one flat PTC electric heating element is positioned between each four of facing heat input faces and a casing made up of two elongated channel-like casing halves, each U-shaped in cross section and having two side flanges, houses the heating structure and forces the bodies together with the heating elements therebetween. The side flanges of the casing halves are overlapped and fixedly secured together along their entire length by a permanent soldered, welded or crumped metal joint so that the bodies and PTC heating elements within the casing are acted upon by a controlled force, transmitted by the casing through the bodies, normal to the heat input faces, for the full life of the water heater. The flow passage can be formed by a hair-pin shaped continuous pipe nested in a groove in the bodies or by a hole running through each body and joined to form a continuous flow path by aligned openings in the facing heat input faces.

14 Claims, 10 Drawing Figures

CONTINUOUS FLOW ELECTRIC WATER HEATER

BACKGROUND OF THE INVENTION (i) Field to which invention relates

The invention is with respect to a continuous flow heater with a compound heating structure made up of bodies of material with a high thermal conductivity and each having a heat input face and a fluidway running through it for fluid to be continuously heated, the bodies being so positioned that their heat input faces are turned towards each other and the fluidways are parallel to each other, with at least one heating element placed between the heat input faces, and with a casing forcing the bodies together with the heating element therebetween. More specially, though not in all cases so, the invention is with respect to a continuous flow heater on these lines used as an evaporator or broiler in beverage making machines such as coffee making machines or the like. Continuous flow heaters of this sort may furthermore be used for many other purposes in the most different walks of life and for different heating powers.

(ii) The prior art

In the case of an earlier design of continuous flow heater of the sort noted the bodies take the form of sectors of cylinders put together for forming a complete cylindrical heating structure and pushed together with a certain force by a cylindrical casing, made for example of flexible sheet metal for tightly forcing the parts together. The heating elements are in this case placed between two radial faces (turned towards each other) on each one cylinder sector and the next one. The fluidways, which are parallel to each other and to the axis of the cylinder, for the fluid as for example water to be heated, are joined with each other without the cylinder sectors by pieces of flexible pipe or connection covers having connection fluidways (see German Offenlegungsschrift specification No. 2,804,749).

This known design of continuous flow heater of the sort noted has generally gone down well in the trade because of the thermal efficiency and the simple process for making it, this being true more specially in the case of higher electrical power levels. On the other hand for designing apparatus with a generally low electrical power and which is generally produced on a mass scale, so that a low price is more specially to be desired, the prior art design noted has not been able to be produced with the low material and labor costs desired in industry. Furthermore, designing for different heating levels generally makes it necessary for the heating structure to be made up of a different number of cylinder sectors with different sector angles so that a great number of different parts have to be kept on hand and warehoused.

OUTLINE OF THE INVENTION

In the present invention, as was the case with the prior art continuous flow heater noted as well, the heating elements take the form of positive temperature coefficient (PTC) material elements, which are generally produced with a prismatic form with two opposite plane-parallel faces and a round or many-cornered outline in plan. They are generally made of a ceramic material, more specially based on barium titanate, and because of the positive temperature coefficient there is an automatic leveling off of the power uptake because, putting it differently, the electrical resistance undergoes a great increase at a certain temperature range. Electrical connection of such PTC elements is generally made by contacting the two opposite faces by use of a metallized layer produced in some way or other and by using contacting plates which are joined up with electrical wiring. The electrical power uptake and for this reason the heat output is in the case of PTC elements generally dependent on the heat output, and for this reason, on the fact that there is low thermal resistance between the PTC elements and the parts to be heated, that is to say the bodies of the heating structure. If there is a high thermal resistance, the PTC element will be heated up to the kick-over or transition temperature (in which there is a heavy increase in the electrical resistance) even at a low power uptake, the heating effect or heat output then falling far short of what is desired, even although, it is true, the shortcoming of overheating is put an end to. For this reason it is important to make a design in which, for the full life of the heating system, the same thermal resistance will be kept to, that is to say the heating elements are to be firmly forced against the heat uptake faces without any changes in this condition.

One purpose of the invention is that of designing a continuous flow heater of the sort noted which may be produced, using the least possible number of different parts, for different power ranges, and more specially low power ranges, with low needs with respect to labor and working material, and in the case of which, furthermore, a high thermal efficiency is kept up for a long working life.

For effecting these and other purposes the bodies of the heat structure are generally parallelpiped-like and the casing is made up of two channel-like casing halves with two side flanges running out from a floor part, the flanges of one casing half being joined with those of the other half along edges of the flanges running in their length direction so that parts in side the casing are acted upon by a force normal to said heat input faces. Because the heating structure is made up using parallelpiped-like bodies the desired pushing force may be more readily produced with a better effect, the force keeping the heating elements fully against the heat input faces. This force is kept up in the working life of the system by the casing, it being important in this respect that, as part of the invention, the casing is not fixed together by fixing screws, clips or the like and in fact the shells or casing halves are placed loosely together and are joined together under a force acting on the made-ready system made up of the casing halves, the bodies and the heating elements. In this respect a much higher force may be produced than is the case with prior art continuous flow heaters and furthermore trouble conditions caused by an uneven force (because of uneven screwing up of screws, friction of the casing on the bodies etc.) may be completely taken care of. The force coming into play right at the start on doing up the casing, when the two casing halves or shells are joined together, will be kept up for the full working life of the continuous flow heater. In this respect the system is best so designed that the two side flanges of each casing half are overlapped and the overlapping parts joined together. For making certain of a low price for producing the system and of a long working life without any change in the properties, it is best for the casing halves to be joined together permanently, that is to say using a form of joint which may not be undone without destruction of the casing.

Such a manner of joining the side flanges may be produced by soldering, welding or by a folded metal lip.

In one form of the invention which is more specially designed for low powers, and for this reason is specially preferred, the heating structure is made up of only two bodies, although it is readily possible to make use of more than two bodies with heating elements placed therebetween so that a stacked heating structure is produced which is housed in the two casing halves or shells, whose side flanges are made representatively longer.

For keeping up the force acting on the bodies for a long working life the selection of the working material of the bodies is an important question, and with a view to getting a high thermal conductivity, it would seem best to make use of materials such as copper or aluminum, although it has turned out that these materials have a high tendency towards creep so that, as times goes by, there will be a loss of the full loading force present at the start. For this reason, as a further development of the invention, it is best for the bodies to be made of brass so that an even and high force will be kept up for a long time. For two shells or halves of the casing are best made of sheet steel. In some cases it may be best for a bedding layer of elastomeric material with a generally high modulus of elasticity (that is to say with a generally low compressibility) to be placed between at least one of the bodies and the casing round it, this stopping any expansion, warping or signs of creep, which may take place after a certain length of working life, from causing anything more than a slight decrease in the sandwiching force level in existence at the time of making the continuous flow heater.

It has been noted at the start of this specification that, as part of the invention, the heating element or elements are best made of a PTC material. In this respect it is best for the heating element to have an electrical contacting structure on opposite faces on the PTC material, the contacting structure being contacted itself by two generally flat contacting leaves, generally having the same outline as the PTC elements, the contacting leaves or plates being places loosely on top of each other with the PTC elements between them and being elastically locked together by keepers, fixed on their sides and for example being of U-cross-section rail of elastomeric material. As a general rule, between the contacting leaves or plates and the bodies of the heating structure electrically insulative separating layers with the highest possible thermal conductivity will be sandwiched, such layers being for example of mica or the like. Electrical connection of the heater will be by way of electrical leads joined up with lugs on the contacting leaves by soldering, spot-welding, crimping or the like. Steps will best be taken to see that the distance between the keepers is generally the same as the breadth of the bodies and the breath of the keepers is generally equal to the distance between the bodies and the next side flange. The design and sizing of the heating elements so far noted and the use of the keepers makes certain of a high heat takeup or thermal transition and further makes certain that the heating elements may be handled before and on making a continuous flow heater of the present invention without any trouble conditions or damage being caused. For running through and fixing the electrical leads, joined up with the contacting leaves, the side flanges are best made with side cutouts and/or other forms of openings.

With respect to the joining together of the fluidways to make up a single fluidway through the heater a number of different designs are possible in the invention. Firstly, the fluidways may naturally be joined up, as was the case with the prior art continuous flow heater noted, by connections placed at the ends of the bodies, and by pieces of flexible pipe slipped over the ends of the fluidways, if the fluidways are formed by pipes.

Another possible way of joining up the fluidways outside the bodies, offering useful effects with respect to cutting down labor and making certain of safe operation, is such that the fluidways take the form of a single-piece length of pipe running through the heater and being placed in lengthways grooves, more specially in faces opposite to the heat takeup faces, the pipe being heat conductingly joined up with the bodies, for example by soldering. The pipe will then be bent between one body and the next one to take on the form of a hairpin. It is naturally possible for the pipe to have some different design outside the bodies but however if bent like a hairpin the lowest heat losses will be produced. This form of the invention, which may readily make use of two or more bodies will be responsible, in each case, for a series-circuiting of the separate fluidways within the bodies.

In the case of a further form of the invention, which is marked by being simple to make, only causing low heat losses and having a small size, the joining together of the fluidways takes placed inside the structure as it were. In this design the fluidways are formed in the bodies so as to be opening at the heat uptake face but naturally at positions clear of the heating elements, the outlet opening of one body and the next one being in line with each other and having a joining up gasket of elastic material between them which is forced against the heat uptake faces. The fluidways for continuous flow and the outlet openings may be produced, for example by casting or later boring in the bodies. An other possible design, specially low in price, is such that the bodies are produced as lengths of bar material with a hole stretching from one end to the other so that the outlet openings may be produced by drilling and the no longer needed end parts of the lengthways hole may be stoppered at the end of the body. In this case, the connection between the fluidways for continuous flow is produced by connection gaskets positioned between the outlet openings, such gaskets being sandwiched and forced sealingly against the bodies when the structure is forced together on assembly. In the case of this form of the invention the continuous fluidways may be joined up in series or in parellel, this being dependent on if one or two outlet openings are present on each heat uptake face.

BRIEF DESCRIPTION OF THE DRAWINGS

An account will now be given of the invention making use of only a small number of working examples to be seen in the figures.

DETAILED ACCOUNT OF WORKING EXAMPLES

Figure 1:
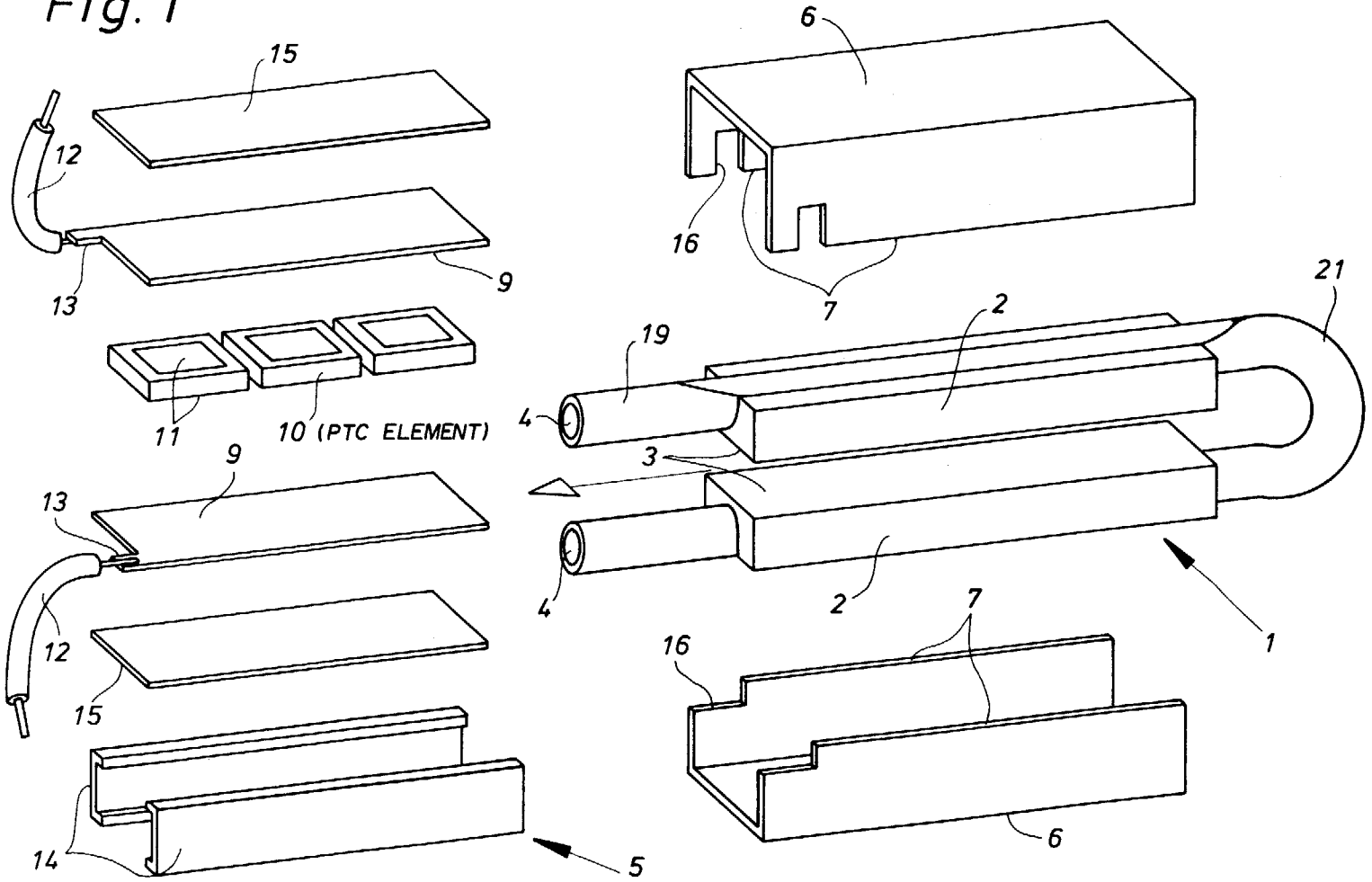
FIG. 1 is a perspective, exploded view of a continuous flow heater.
Figure 2:
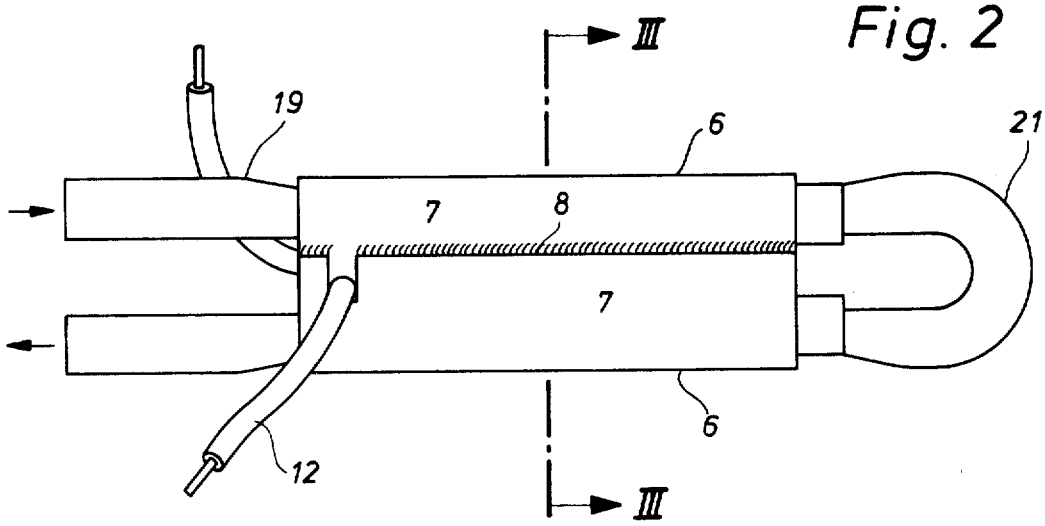
FIG. 2 is a view of the heater of FIG. 1 in the assembled condition.

The continuous flow heater to be seen in FIGS. 1 and 2 is made up firstly of a heating structure 1, which in turn is made up of two parallelpiped-like brass bodies 2 with heat input faces 3 turned towards each other. The bodies or segments have fluidways 4, parallel to each other and to the axis of the structure, for a fluid to be heated as for example water and which are joined together as will be detailed later on. Between heat uptake faces 3 heating element 5 is positioned, which the reader will see in FIG. 1 has been pulled out to the left. Details will be given of it later on.

The heating structure 1 is housed within a casing which is made up of two housing halves or shells 6 which are of channel section, each one thereof taking up one of the two bodies 2. The side walls or flanges 7 of casing halves 6 are overlapped in the assembled condition (see FIG. 2) in pairs and, where they are overlapping, are welded together along their edges running in the length direction, the welds being numbered 8. Such welding is undertaken after assembly while the parts of the system (that is to say the casing halves 6 or shells, bodies 2 and heating element 5) are forced together or loaded in a direction normal to the heat uptake faces 3.

The heating element generally numbered 5 is made up of a sandwich-like system having two generally flat contacting leaves 9 or sheets between which PTC elements 10 are positioned. These elements 10 have a contacting layer 11 on opposite faces. The electrical connection is made by way of electrical leads 12 joined with lugs 13 of contacting leaves 9. Heating element 5 is made ready for assembly of the continuous flow heater by placing the contact leaves 9 (having in plan the same form as the PTC element 10) loosely against elements 10 and then elastically sandwiching the complete structure by keepers 14 of U-like cross-section and made of silicone rubber. These keepers are simply slipped over the edges of the contacting leaves. These leaves 9 are made of a material with a high thermal conductivity, as for example copper and on their outer sides, facing away from the heating element 5, there is an insulating layer 15 of mica, which is kept in position as well by keepers 14. The breadth of the PTC elements 10 is generally equal to the breadth of bodies 2. Furthermore the heating element 5 is of such a size that the distance between the keepers 14 is generally equal to the breadth of the bodies and the breadth of the keepers 14 is generally equal to the distances between the bodies 2 and the side flange 7 next to it. As the reader will more specially be able to see from FIG. 1, the side flanges 7 have edge cutouts 16 through which leads 12 are run and by which they are supported.

Figure 3:
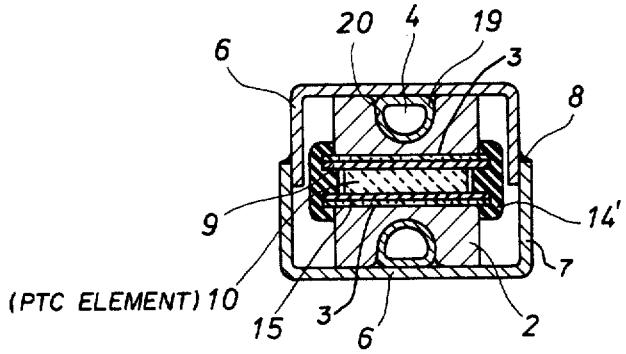
FIG. 3 is a cross-section on the line III—III of FIG. 2, but a modified form of keeper and size of PTC element.
Figure 4:
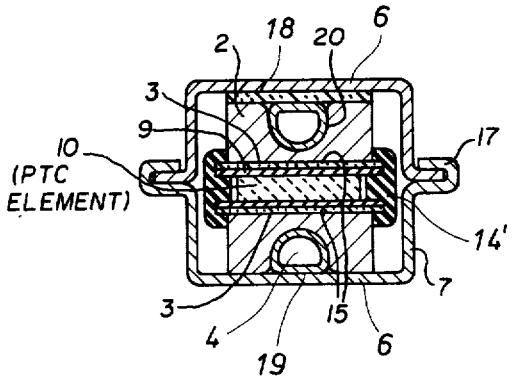
FIG. 4 is a view of a further form of the structure of FIG. 3.

In the case of the working example of FIGS. 1 to 3 the side flanges 7 of casing halves 6 are welded together. In FIG. 4 a further working example will be seen in the case of which the side flanges 7 are joined up by a folded round edge part 17. Furthermore in the working example of FIG. 4 an in-between layer 18 of elastic material with a comparatively high modulus of elasticity is sandwiched or gripped between the top body 2 or segment and the casing half 6 in which the same is nested.

In the case of the working examples to be seen in FIGS. 1 to 4 the fluidways 4 or continuous flow ducts are formed by a single-piece pipe 19 of copper, which is soldered in grooves 20 formed in the faces, opposite to the heat uptake faces 3, of bodies 2. The copper pipe 19 is, at least where it is next to the bodies 2, so formed and soldered in position, that it is generally in the same plane as the outer faces, turned towards the housing or casing halves 6, of bodies 2. The connection outside the bodies of the fluidways 4 is produced by the pipe 19 being bent like a hairpin in the part 21 between bodies 2. The connection of input and output pipes (not numbered) is at the ends of pipe 19.

Figure 5:
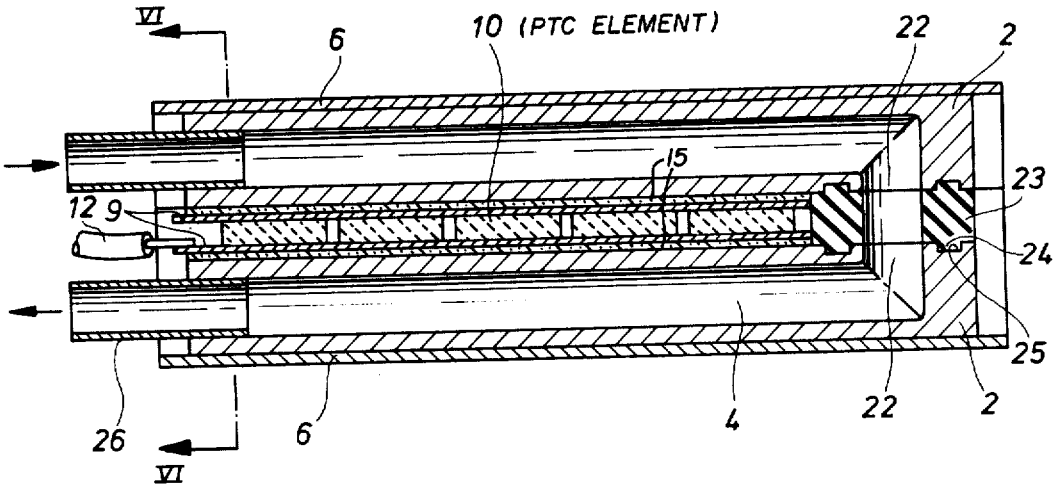
FIG. 5 is a view of a further form of a continuous flow heater, in lengthways section.
Figure 6:
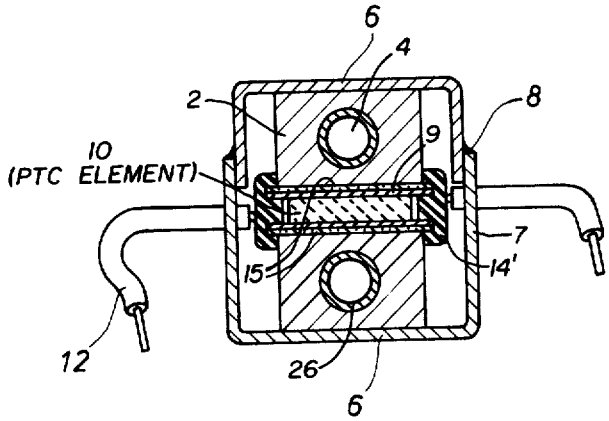
FIG. 6 is a cross-section on the line VI—VI of FIG. 5.
Figure 6A:
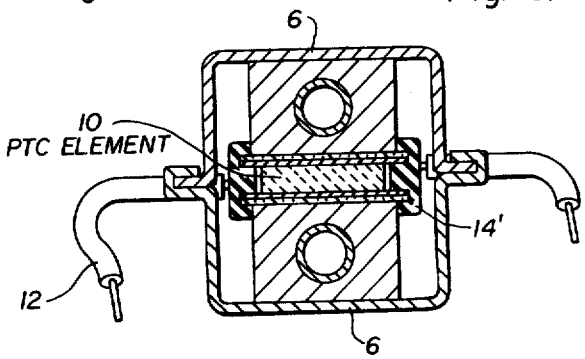
FIG. 6A corresponds to FIG. 6 with a modification to the casing.

The working example of the invention to be seen in FIGS. 5 and 6 is generally the same as that of FIGS. 1 to 3, but for different design points which will be separately noted. The fluidways 4 are in this case however produced in bodies 2, each having an outlet opening 22 at the heat input or takeup face 3 of the body 2 in question. The outlet openings 22 of the two bodies 2 of FIGS. 5 and 6 are placed in line with each other. Between these lined-up outlet openings 22 there a connection gasket 23 of elastic material of such a height or length that on sandwiching the structure together, the sandwiching force is responsible for forcing gasket 23 sealingly against the opposite heat takeup faces 3 and for this reason producing the connection between the two fluidways 4. For a further sealing effect connection gasket 23 has, on its two end faces, a ring-like gland lip 24 which is fluid-tightly taken up in a round cut 25 skirting outlet opening 22. The connection of the inlet and outlet pipes (not numbered) is by way of hollow stems 26 which are cemented in fluidways 4. The embodiment of FIG. 6A is identical to that of FIG. 6, except that the casing halves are connected by folding instead of welding.

Figure 7A:
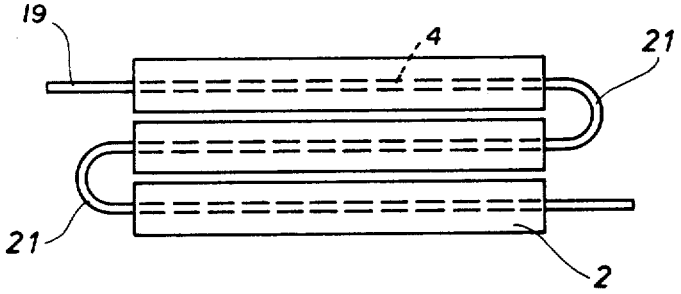
FIGS. 7A, 7B, and 7C are diagrammatic views illustrating different ways of joining up the fluidways.
Figure 7B:
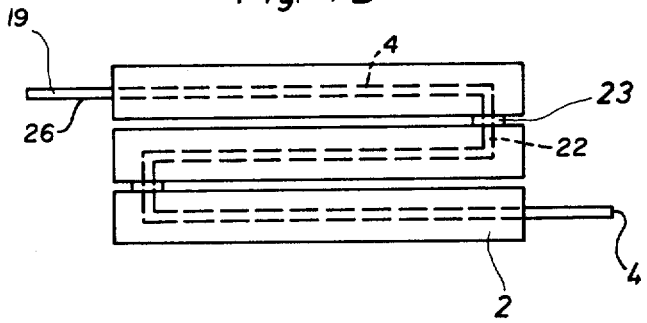
Figure 7C:
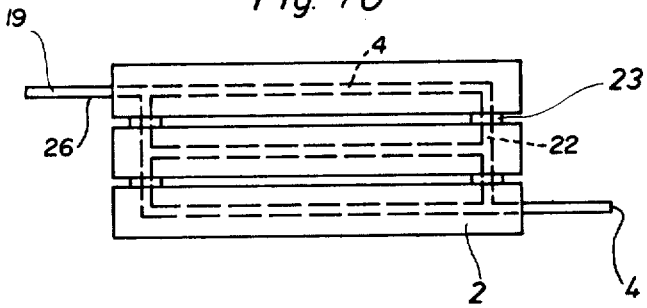

FIGS. 7A to C diagrammatically make clear different ways for joining up fluidways 4 and in FIG. 7A it is a question of three bodies 2, placed one on the other and whose fluidways 4 are joined in series at the outside and are formed by a single-piece pipe 19 running right through the structure. Pipe 19 is bent twice at 21 like a hairpin.

In FIGS. 7A and 7C it is again a question of a heating structure, made up of three bodies 2 to make clear two different possible ways for joining up the fluidways 4 within the structure, such fluidways being seen in FIGS. 5 and 6. In the case of FIG. 7B at each heat takeup face 3 there is one outlet opening 22 so that, seen generally, fluidways 4 will be joined up in series with 180° changes in direction at their ends. In FIG. 7C at each heat takeup face 3 there are two outlet openings 22 so that the single fluidways 4 are joined up in parallel with each other.

In FIGS. 3–6, a modified form of keeper 14' is shown used in the situation where the PTC elements 10 are not as wide in plan as the contacting leaves 9 and insulating layers 15. The modified keeper 14' is E-shaped instead of U-shaped, the central flange of which is shown as being substantially of the same thickness as the PTC element and entering the edge gaps between leaves 9 created because of the lesser width of the PTC elements.

We claim:

1. A continuous flow heater having a compound heating structure made up of at least two elongated generally parallelpiped-like shaped bodies of material with a high thermal conductivity, each such body having at least one heat input face and a fluidway running through it for fluid to be continuously heated, the bodies being positioned side-by-side with a heat input face of each body facing a heat input face of the next adjacent body and with the fluidways parallel to each other, at least one heating element positioned between each pair of facing heat input faces, and a casing forcing the bodies together with the heating element therebetween, wherein said casing is made up to two elongated channel-like casing halves, each half being U-shaped in cross section and having two side flanges running out from a floor part along the length of said bodies, the flanges of one casing half being permanently fixedly joined with those of the other casing half along substantially the entire length of the flanges so that the bodies and the heating element within the casing are acted upon by a force, transmitted by said casing through said bodies, normal to said facing heat input faces.

2. The structure as claimed in claim 1, wherein the side flanges of the casing halves are overlapped and joined together at positions of overlap.

3. The structure as claimed in claim 2, wherein said side flanges are joined together by fused metal.

4. The structure as claimed in claim 2 or 3, wherein said side flanges extend parallel to said normal force at said positions of overlap.

5. The structure as claimed in claim 1, wherein said side flanges are joined together by folded round metal edge parts.

6. The structure as claimed in claim 1 or 5, wherein said fluidways are in the form of holes running through the material of said bodies and having openings in parts of said facing heat input faces, openings of the facing heat input faces of adjacent bodies being lined up with each other for connecting the fluidways thereof, the heater further having a ring-like elastomeric gasket placed between these said parts of its heat input faces around said openings so as to be sealingly sandwiched between said facing heat input faces by said normal force.

7. The structure as claimed in claim 1, wherein the bodies are made of brass.

8. The structure as claimed in claim 1, having an inbetween layer of elastomeric material sandwichingly placed between at least one of the bodies and the casing half in which this body is nested.

9. The structure as claimed in claim 1 or 2 or 3 or 5 or 7 or 8, wherein each heating element is made up of positive temperature coefficient (PTC) element, having a contacting layer on opposite faces, and at least two metallic contacting leaves which are generally flat and at least as large in plan as the PTC element, and wherein the contacting leaves each have a terminal for connection to a power supply, are loosely placed on top of each other with the PTC element between them in electrical contact therewith, and are elastically kept together by keepers of electrically non-conductive material placed at their edges, and wherein an electrical insulating means of good thermal conductivity is disposed between the contact leaves and the facing heat input faces between which the heating element is positioned.

10. The structure as claimed in claim 9, wherein the keepers are placed at a distance generally equal to the breadth of the bodies and the breadth of the keepers is generally equal to the distance between the bodies and a respective adjacent one of said side flanges.

11. The structure as claimed in claim 9 wherein said terminals comprise lugs on the contact leaves and leads fixed thereto, the leads being threaded through cutouts in said side flanges.

12. The structure as claimed in claim 9, wherein said keepers are generally U-shaped in cross-section, having a gap between legs thereof of a width corresponding to the combined thickness of said insulating means, contacting leaves and heating element.

13. The structure as claimed in claim 9, wherein the keepers are generally E-shaped in cross section, having a gap defined between a middle leg and each of respective outer legs, said middle leg having a thickness corresponding to that of said heating element and each gap having a width corresponding to the combined thickness of a respective insulating layer of said insulating means and a respective one of said contacting leaves.

14. The structure as claimed in claim 1, having a single-piece pipe forming the fluidways, said pipe being heat conductingly nested in grooves in said bodies, said grooves running lengthways of said structure, said pipe being bent into hairpin form.

* * * * *